US007842230B2

(12) United States Patent
Tanaka et al.

(10) Patent No.: US 7,842,230 B2
(45) Date of Patent: Nov. 30, 2010

(54) CONTINUOUS CARBURIZING FURNACE

(75) Inventors: Yasunori Tanaka, Tenri (JP); Masanori Minamiguchi, Tenri (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 550 days.

(21) Appl. No.: 11/869,829

(22) Filed: Oct. 10, 2007

(65) Prior Publication Data

US 2008/0258360 A1 Oct. 23, 2008

(30) Foreign Application Priority Data

Feb. 13, 2007 (JP) ..... 2007-031780

(51) Int. Cl.
*C21D 1/06* (2006.01)

(52) U.S. Cl. ..... 266/252; 266/251

(58) Field of Classification Search ..... 266/251, 266/252

See application file for complete search history.

(56) References Cited

U.S. PATENT DOCUMENTS 7,507,087 B2 * 3/2009 Tenzek ..... 432/126

FOREIGN PATENT DOCUMENTS

JP 2004-010945 1/2004
JP 2006137964 A * 6/2006

* cited by examiner

*Primary Examiner*—Scott Kastler
(74) *Attorney, Agent, or Firm*—Renner, Otto, Boisselle & Sklar, LLP

(57) ABSTRACT

A continuous carburizing furnace includes a furnace having a carburizing zone for performing a carburizing process on a workpiece while the workpiece is conveyed; and a plurality of regions disposed successively in a direction of conveyance upstream from the carburizing zone, the carburizing zone being provided with an intermediate door being opened and closed between the carburizing zone and the upstream side therefrom. Also included is at least a single lift mechanism for lowering the workpiece in a region other than a region of the most upstream side among the plurality of regions; and a plurality of pushers for pushing the workpiece at each of the plurality of regions to regions downstream therefrom or to the carburizing zone, the plurality of pushers being disposed so as to push the workpiece at successively lowered levels of height one after another in the direction of conveyance.

6 Claims, 3 Drawing Sheets

CONTINUOUS CARBURIZING FURNACE

CROSS REFERENCE

This Non-provisional application claims priority under 35 U.S.C. §119(a) on Patent Application No. 2007-031780 filed in Japan on Feb. 13, 2007, the entire contents of which are hereby incorporated by reference.

BACKGROUND OF THE INVENTION

The present invention relates to a continuous carburizing furnace which performs a plurality of processes, including a carburizing process, successively upon a workpiece, the subject for processing, which is being conveyed in an ambient atmosphere which includes a carburizing gas.

With a continuous carburizing furnace, a heating zone, a carburizing zone, a diffusion zone, a cooling zone, and so on are provided within the furnace. A workpiece which has been loaded upon a tray is subjected to processing in each of these zones, while the tray is conveyed from a transport entrance of the furnace towards a removal aperture thereof.

As methods for conveying the workpiece within the furnace, both the tray pusher method and the roller hearth method are available. With a continuous carburizing furnace which utilizes the tray pusher method, as for example disclosed in Japanese Laid-Open Patent Publication 2004-10945, a tray most to the upstream side is pushed by a pusher from the transport entrance towards the removal aperture, and thereby a plurality of trays are conveyed while being kept in mutual contact. On the other hand, with a continuous carburizing furnace which utilizes the roller hearth method, a large number of hearth rollers which are arranged across the floor of the furnace are rotationally driven, so that the trays are shifted over these hearth rollers.

It is necessary to apply mutually different levels of heating energy to the heating zone and to the carburizing zone within the furnace. Furthermore, the carburizing zone receives an input of a carburizing gas. In order to enhance the product quality of the workpiece after carburizing processing, it is necessary to keep the temperature and the ambient atmosphere in each zone constant; and, to this end, it has been contemplated to selectively isolate the heating zone, in which the temperature differences with the previous and successive zones are most conspicuous, with intermediate doors which are opened and closed as required.

With the roller hearth method, it is possible to adjust the gaps between the various trays in a simple and easy manner by controlling the rotation of the hearth rollers. Due to this, continuous carburizing furnaces which utilize the roller hearth method, and in which intermediate doors are installed between the heating zone and the carburizing zone, are nowadays widespread.

However, with a continuous carburizing furnace which utilizes the roller hearth method, it is necessary to drive the large number of hearth rollers from the exterior, and a considerable amount of thermal energy is wasted by thermal diffusion from the side walls of the furnace in which the shafts of the hearth rollers are supported. Furthermore, it becomes necessary to oscillate the hearth rollers by rotating them forwards and backwards periodically in order to prevent deflection of the hearth rollers due to the loadings imposed upon them from the trays, so that the drive control of the rollers becomes troublesome. Moreover, the maintenance of this large number of hearth rollers also becomes complicated and troublesome. Yet further, the size of the furnace is increased due to the provision of the gaps between the plurality of trays.

On the other hand, with a continuous carburizing furnace which utilizes the tray pusher method, it is possible to eliminate the above described shortcomings of the roller hearth method; and, by changing the stroke of the pusher, it is possible to provide a gap between the tray which is most towards the upstream side and the tray in front of it. However, a purge chamber which is provided with an intermediate door between itself and the heating zone is present at the transport entrance side of the furnace, and it is not possible to bring in the next tray to this purge chamber until the previous tray has been conveyed from the heating zone to the carburizing zone, so that the time period between bringing in trays becomes long.

Moreover, by providing a plurality of pushers whose pushing angles in plan view are mutually orthogonal, and by changing the direction of conveyance of the trays within the furnace in a zigzag manner, it is possible to create a gap between a pair of trays, during their passage through the furnace. However, in this case, the shape of the furnace in plan view cannot be made to be linear, so that the area which the device occupies is increased in size.

The objective of the present invention is to supply a continuous carburizing furnace which operates according to the tray pusher method, with which, while maintaining the shape in plan view of the conveyance path as being a straight line, the conveyance path for trays with workpieces loaded upon them is made to include a plurality of stages at the upstream side of the carburizing zone, and with which, by providing a plurality of pushers which push the trays at each stage, it is made possible to establish gaps between each of the trays being successively conveyed and the next one, in order to allow the operation of intermediate doors which are installed.

SUMMARY OF THE INVENTION

The continuous carburizing furnace of the present invention includes a furnace having a carburizing zone for performing a carburizing process on a workpiece while the workpiece is conveyed therein along a direction of conveyance; and a plurality of regions disposed successively in said direction of conveyance in upstream side from said carburizing zone, said carburizing zone being provided with an intermediate door being opened and closed between said carburizing zone and said upstream side there from; at least a single lift mechanism for lowering the workpiece in a region other than a region of the most upstream side in said direction of conveyance among said plurality of regions; and a plurality of pushers for pushing the workpiece at each of said plurality of regions to regions of a downstream side there from in said direction of conveyance or to said carburizing zone, said plurality of pushers being disposed so as to push the workpiece at successively lowered levels of height one after another in said direction of conveyance.

DETAILED DESCRIPTION OF THE INVENTION

Figure 1:
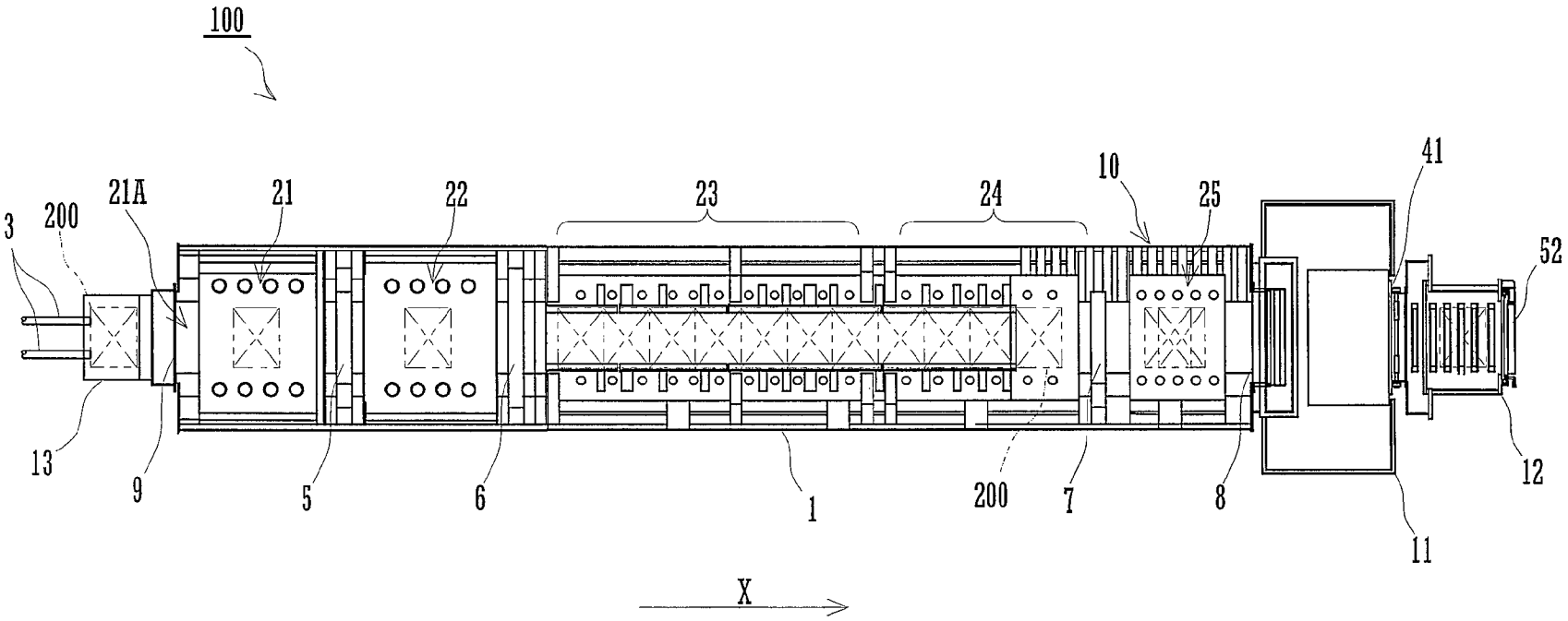
FIG. 1 is a plan sectional view of a continuous carburizing furnace according to an embodiment of the present invention.
Figure 2:
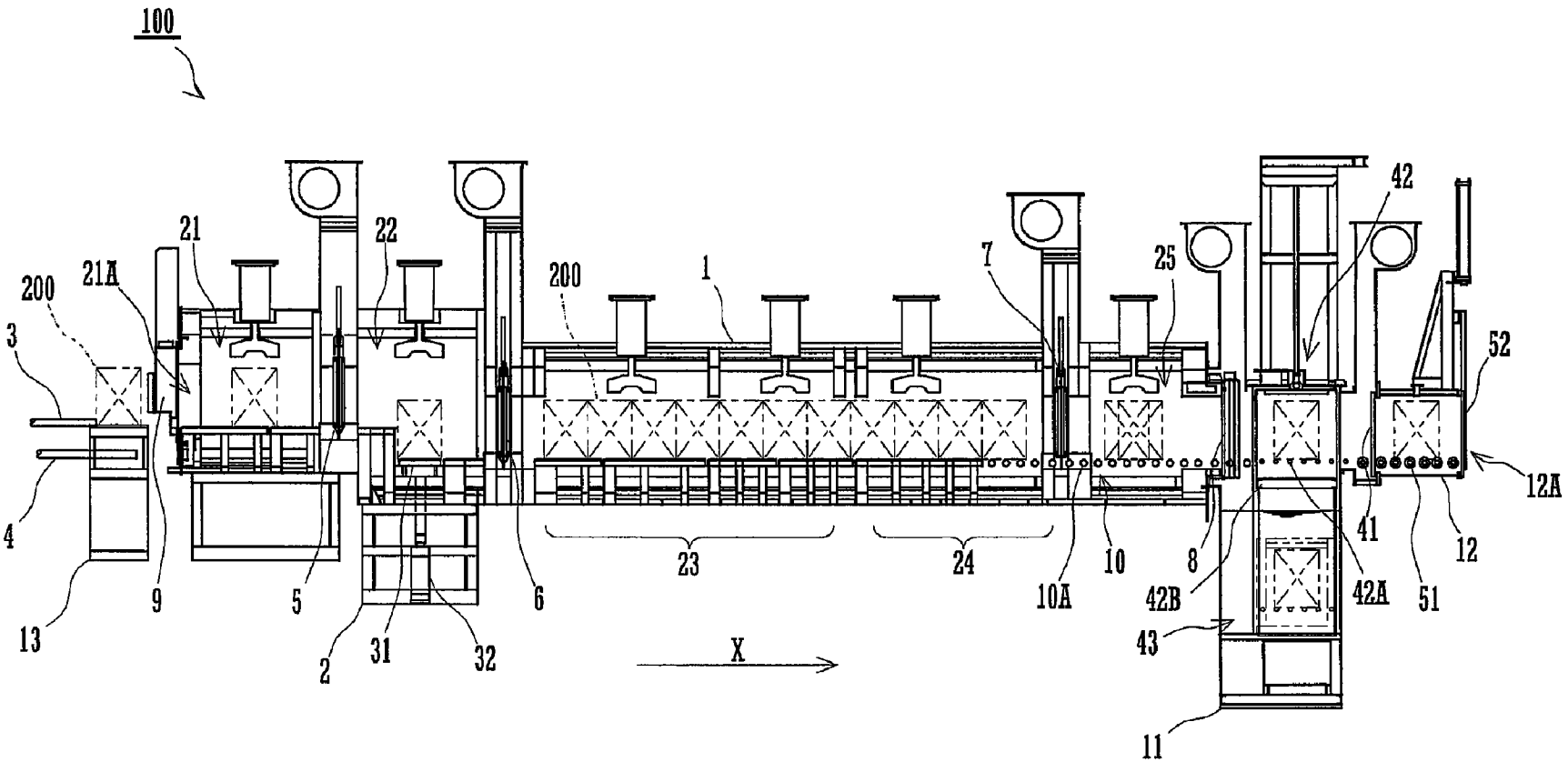
FIG. 2 is a side sectional view of this continuous carburizing furnace.

In the following, an embodiment of the present invention will be described in concrete terms with reference to the drawing. FIG. 1 is a plane sectional view showing an example of a continuous carburizing furnace according to an embodiment of the present invention. And FIG. 2 is a side sectional view of this continuous carburizing furnace.

This continuous carburizing furnace 100 continuously performs, as one example, pre-processing, heating processing, carburizing processing, diffusion processing, cooling processing, and quenching processing upon workpieces which are loaded upon trays during conveyance along a conveyance path which is shaped as a straight line in plan view. This continuous carburizing furnace 100 is a continuous carburizing furnace employing a hybrid method, and conveys trays which are loaded with a large number of workpieces through pre-processing, heating processing, carburizing processing, and diffusion processing by a tray pusher method, and then conveys them through cooling processing and quenching processing by a roller hearth method. And this continuous carburizing furnace 100 comprises a furnace main body 1, a lift mechanism 2, pushers 3 and 4, intermediate doors 5 through 8, an introduction door 9, a roller hearth 10, a quenching device 11, and a removal device 12.

The furnace main body 1 is the "furnace" of the Claims, and, in plan view, is made as a rectangle of approximately constant width, extending along the direction of conveyance of trays 200, as shown by an arrow sign X. A purge chamber 21, a heating chamber 22, a carburizing zone 23, a diffusion zone 24, and a cooling zone 25 are arranged in that order in the furnace main body 1, along the direction of the arrow sign X. The purge chamber 21 and the heating chamber 22 correspond to the "plurality of regions" of the Claims.

In this example, in the purge chamber 21, heat at approximately 400° C. is applied to a workpiece which is loaded upon a tray 200 in an ambient atmosphere which has been isolated from the external air, and pre-processing such as degreasing processing and so on is performed thereupon. The purge chamber 21 is not to be considered as being limited by the above; any configuration will be acceptable, provided that it is one with which it is possible to replace the ambient atmosphere therein.

In the heating chamber 22, the workpiece is subjected to preliminary heat application at approximately 900° C. in an ambient atmosphere of a carrier gas such as RX gas or the like.

In the carburizing zone 23, a carrier gas such as RX gas or the like and an enrichment gas such as a hydrocarbon gas or the like are supplied, and carburizing processing is performed by applying heat to the workpiece at approximately 930° C. to 950° C. in an ambient atmosphere of carburizing gas.

In the diffusion zone 24 diffusion processing is performed, in order to diffuse the carbon which has been loaded by the carburizing processing onto the surface of the workpiece, into the interior of the workpiece.

In the cooling zone 25, the workpiece is cooled and soaked to a temperature of approximately 850° C., which is the temperature before the start of quenching processing.

The lift mechanism 2 is disposed in the heating chamber 22, and comprises a lift stage 31, which constitutes a portion of the floor surface of the heating chamber 22, and a raising and lowering cylinder 32.

By raising and lowering the lift stage 31 with the raising and lowering cylinder 32 (which is hydraulically driven), this lift mechanism 2 displaces the conveyance path of the trays 200 downwards. The lift mechanism 2 could also raise and lower the lift stage 31 with a pneumatic drive system or a motor drive system.

The floor surface of the purge chamber 21 is higher than the floor surfaces of the carburizing zone 23 and of subsequent zones. As compared with the conveyance path from an introduction stage 13 to the interior of the purge chamber 21, the conveyance path for the trays 200 from the carburizing zone 23 onwards is lower, so that the conveyance path in the furnace main body 1 is structured in two stages, an upper stage and a lower stage.

In the heating chamber 22, the lift mechanism 2 lowers the trays 200, which are to be displaced from the upper stage conveyance path for the trays 200 to the lower stage conveyance path.

The pushers 3 and 4 are the "plurality of pushers" of the Claims. The pusher 3 is the "first pusher" of the Claims, and pushes the trays 200 in the direction of the arrow sign X from the introduction stage 13 to the purge chamber 21, and from the purge chamber 21 to the heating chamber 22. And the pusher 4 is the "second pusher" of the Claims, and pushes the trays 22 in the direction of the arrow sign X from the heating chamber 22 to the carburizing zone 23.

The intermediate doors 5~8 are the "plurality of intermediate doors" of the Claims. The intermediate door 5 opens and closes between the purge chamber 21 and the heating chamber 22. The intermediate door 6 opens and closes between the heating chamber 22 and the carburizing zone 23. The intermediate door 7 opens and closes between the diffusion zone 24 and the cooling zone 25. The intermediate door 8 opens and closes between the cooling zone 25 and the quenching device 11. And the introduction door 9 opens and closes a transport entrance 21A of the purge chamber 21.

Due to these intermediate doors 5 and 6, it is possible selectively to mutually isolate the purge chamber 21 and the heating chamber 22, and the heating chamber 22 and the carburizing zone 23. It is accordingly made possible to maintain mutually different ambient atmospheres and temperatures in the purge chamber 21, the heating chamber 22, and the carburizing zone 23.

The roller hearth 10 comprises a plurality of hearth rollers 10A, and a motor not shown in the figures which supplies rotatory power to this plurality of hearth rollers 10A. The plurality of hearth rollers 10A are arranged at approximately equal intervals so as to constitute a floor surface from a portion of the diffusion zone 24 on its downstream side via the cooling zone 25 to a portion of the quenching device 11 on its upstream side. Both end portions of each of these hearth rollers 10A are passed through the side walls of the furnace main body 1 so as to be exposed to the exterior of the furnace main body 1, and are supported rotatably by bearings not shown in the figures. And the rotation of the motor is transmitted to the one end portions of each of these hearth rollers 10A.

The quenching device 11 comprises an outlet door 41, a lift mechanism 42 and an oil tank 43. The outlet door 41 opens and closes between the quenching device 11 and the removal device 12. The lift mechanism 42 comprises a lift stage 42B which can be raised and lowered freely, and which comprises a plurality of rollers 42A. A tray 200 which has been brought into the cooling zone 25 is mounted upon this lift stage 42B. The oil tank 43 is disposed below the conveyance path of the tray 200, and stores quenching oil. The lift mechanism 42 lowers the lift stage 42B with a tray 200 mounted upon it, and dips the tray 200 into the oil tank 43. Thereby a workpiece which is loaded upon the tray 200 is abruptly cooled by the quenching oil.

The removal device 12 comprises a plurality of rollers 51 and a removal door 52. This plurality of rollers 51 constitutes a conveyance surface within the removal device 12 for a tray 200. And the removal door 52 controls the opening and closing of a removal outlet 12A of this removal device 12.

FIGS. 3A through 3E are schematic side cross sectional views for explanation of the operation of the principal portions of this continuous carburizing furnace according to an embodiment of the present invention. In the following, the explanation will only focus attention upon the operations related to the intermediate doors 5 and 6 and the introduction door 9 during the processing for bringing in the trays 200 to the purge chamber 21, the heating chamber 22, and the carburizing zone 23; and explanation of the operation of the other doors will be omitted.

Before a tray 200 is brought in, the intermediate doors 5 through 8 and the introduction door 9 are in their closed positions, so that the conveyance path is interrupted at the positions where these doors are disposed. Furthermore, due to considerations of safety, the lift mechanism 2 is waiting in its position with the lift stage 31 lowered.

Figure 3A:
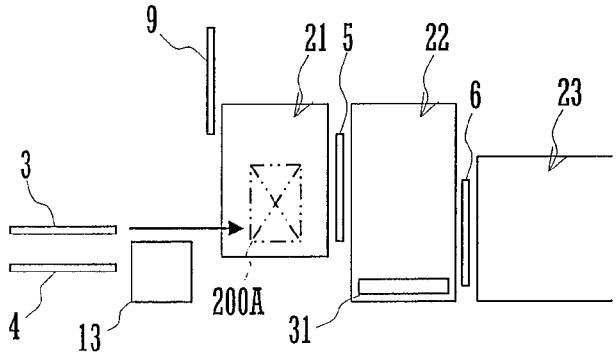
FIGS. 3A through 3E are schematic side cross sectional views for explanation of the operation of the principal portions of this continuous carburizing furnace.

After a first tray 200A with a large number of workpieces loaded upon it has been mounted upon the introduction stage 13, as shown in FIG. 3A, the introduction door 9 is shifted to its open position so that the transport entrance 21A is opened, and the tray 200A is pushed in the direction of the arrow sign X by the pusher 3. Thereby the tray 200A is brought in from the introduction stage 13 to the purge chamber 21. After the tray 200A has been brought into the purge chamber 21, the introduction door 9 is shifted to its closed position, so that the purge chamber 21 is closed. And degreasing processing is performed, in which the workpieces which are loaded upon the tray 200A are heated up to a predetermined temperature within an ambient atmosphere which is isolated from the external atmosphere, so that oil and grease and so on adhering to their surfaces are burnt away.

Figure 3B:
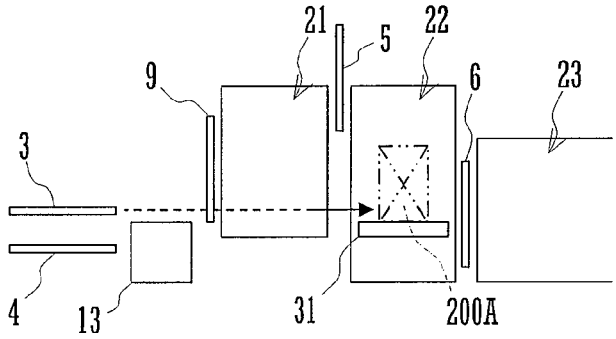

After this degreasing processing has been completed, as shown in FIG. 3B, along with the lift mechanism 2 shifting the lift stage 31 to its upper position and stopping it there, the intermediate door 5 is shifted to its opened position so that the purge chamber 21 and the heating chamber 22 are communicated together, and then the tray 200A is pushed by the pusher 3 in the direction of the arrow sign X. Thus the tray 200A is brought in from the purge chamber 21 to the heating chamber 22, and is mounted upon the lift stage 31. After the tray 200A has thus been brought within the heating chamber 22, the intermediate door 5 is shifted to its closed position, and thereby the communication between the purge chamber 21 and the heating chamber 22 is interrupted. The workpieces which are loaded upon the tray 200A are then subjected to pre-heating processing by the application of heat, so as to heat them up to a predetermined temperature within an ambient atmosphere of carrier gas.

While this pre-heating processing is being performed upon the workpieces which are loaded upon the first tray 200A, a second tray 200B is mounted upon the introduction stage 13, the introduction door 9 is shifted to its opened position so as to open up the transport entrance 21A, and the tray 200B is pushed by the pusher 3 in the direction of the arrow sign X. Thus, the tray 200B is brought into the purge chamber 21 from the introduction stage 13. After the tray 200B has been brought into the purge chamber 21, the introduction door 9 is shifted to its closed position, so that the purge chamber 21 is closed. And the workpieces which are loaded upon the tray 200A are then subjected to degreasing processing by the application of heat at a predetermined temperature within an ambient atmosphere which is isolated from the external atmosphere.

Figure 3C:
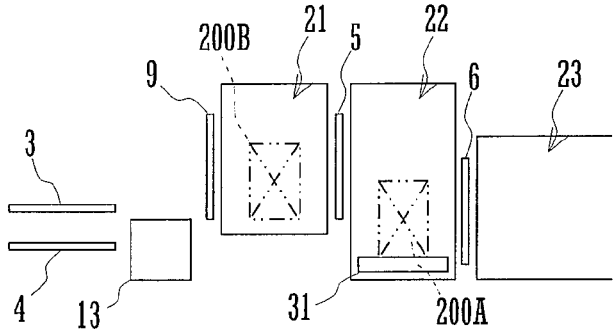

Until the pre-heating processing has been completed upon the workpieces which are loaded upon the tray 200A, the lift stage 31 is kept lowered to its downward position, along with the tray 200A, as shown in FIG. 3C.

Figure 3D:
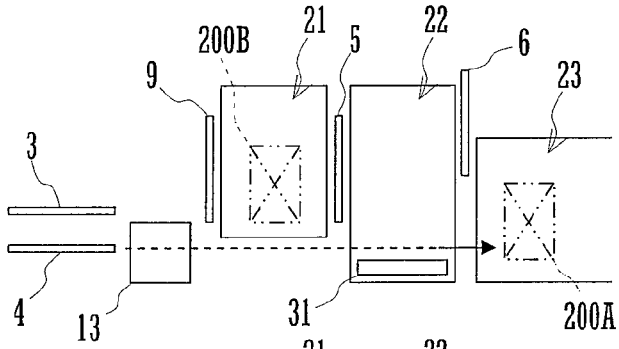

When the pre-heating processing upon the workpieces which are loaded upon the tray 200A has been completed, as shown in FIG. 3D, the intermediate door 6 is shifted to its opened position so that the heating chamber 22 and the carburizing zone 23 are communicated together, and then the tray 200A is pushed by the pusher 4 in the direction of the arrow sign X. Thus the tray 200A is brought into the carburizing zone 23 from the heating chamber 22. After the tray 200A has been brought into the carburizing zone 23, the intermediate door 6 is shifted to its closed position so that the heating chamber 22 and the carburizing zone 23 are isolated from one another. And then carburizing processing is performed upon the workpieces which are loaded upon the tray 200, by application of heat so as to raise them to a predetermined temperature within an ambient atmosphere of carburizing gas.

Figure 3E:
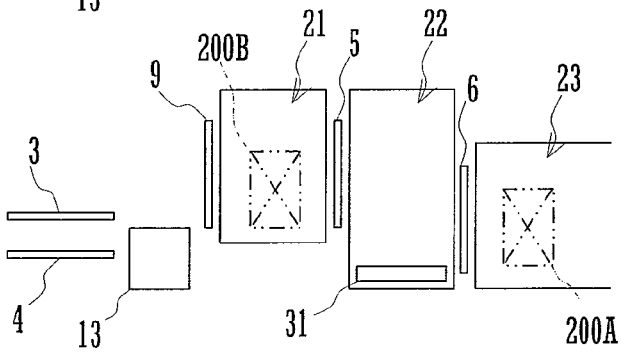

After having brought the tray 200A into the carburizing zone 23, the intermediate door 6 is shifted to its closed position (refer to FIG. 3E). By the above, one cycle of processing to bring a tray 200 into the carburizing zone 23 is completed.

Subsequently, when the operations shown in FIGS. 3B through 3D are performed, and when the tray 200B is brought into the carburizing zone 23 from the heating chamber 22, then the tray 200A is pushed by the tray 200B and is shifted within the carburizing zone 23 in the direction of the arrow sign X. And, as the operations shown in FIGS. 3B through 3E are repeated, the plurality of trays 200 in the carburizing zone 23 and the diffusion zone 24 are shifted in the direction of the arrow sign X due to their state of being in mutual contact.

By providing the lift mechanism 2 in the heating chamber 22, the conveyance path for the trays 200 is structured in two stages, an upper stage and a lower stage, so that, on the upper stage conveyance path from the introduction stage 13 through the purge chamber 21 to the heating chamber 22, the trays 200 are pushed by the upper stage pusher 3, while, on the lower stage conveyance path from the heating chamber 22 to the carburizing zone 23, the trays 200 are pushed by the lower stage pusher 4. According to this structure, on the upstream side of the carburizing zone 23 in the conveyance path, between each pair of trays 200 which are being conveyed, it is possible to establish a suitable gap for installation of the intermediate door 6.

It is also possible to convey the plurality of trays 200 within the carburizing zone 23 in mutual contact, if the purge chamber 21 and the heating chamber 22 on the upstream side of the carburizing zone 23 in the conveyance path are arranged in a state in which it is possible to mutually isolate them by the intermediate doors 5 and 6. And it is possible, while shortening the overall length of the furnace, and while keeping the area which it occupies compact, to perform pre-processing in the purge chamber, pre-heating processing in the heating chamber 22, and carburizing processing upon a large number of workpieces in the carburizing zone, in a uniform manner.

While, in the embodiment described above, the purge chamber 21 and the heating chamber 22 were disposed on the upstream side of the carburizing zone 23 in the conveyance path, the present invention is not limited to the case in which such processing is performed in the two regions; it would also be acceptable for these to be regions in which other types of processing are performed. Moreover, it would also be possible to implement the present invention in a similar manner, with three or more regions being provided. In this case, the same number of pushers as the number of regions would be arranged in upper and lower stages, lift mechanisms would be provided to each of the regions with the exception of the region most towards the upstream side, and the same number of stages of conveyance path as the number of regions would be provided as upper and lower stages.

It should be understood that, in the above described explanation of an embodiment of the present invention, all of the features are shown by way of example, and should not be considered as being limitative of the present invention. The scope of the present invention is not to be defined by any of the features of the embodiment described above, but only by the scope of the appended Claims. Moreover, equivalents to elements in the Claims, and variations within their legitimate and proper scope, are also to be considered as being included within the range of the present invention.

What is claimed is:

1. A continuous carburizing furnace, comprising:

a furnace including:

a carburizing zone for performing a carburizing process on a workpiece while the workpiece is conveyed therein along a direction of conveyance; and a plurality of regions disposed successively in said direction of conveyance in an upstream side from said carburizing zone, said carburizing zone being provided with an intermediate door being opened and closed between said carburizing zone and said upstream side therefrom;

at least a single lift mechanism for lowering the workpiece in a region other than a region of the most upstream side in said direction of conveyance among said plurality of regions; and a plurality of pushers for pushing the workpiece at each of said plurality of regions to regions of a downstream side therefrom in said direction of conveyance or to said carburizing zone, said plurality of pushers being disposed so as to push the workpiece at successively lowered levels of height one after another in said direction of conveyance.

2. The continuous carburizing furnace according to claim 1, further comprising a plurality of intermediate doors being selectively opened and closed between any successive pair of said plurality of regions, and between a region of the most downstream side of said plurality of regions and said carburizing zone.

3. The continuous carburizing furnace according to claim 1, wherein said plurality of regions include a purge chamber adapted for isolating interior thereof from exterior atmosphere, and a heating chamber for heating the workpiece up to a pre-heating temperature that is not higher than a carburizing temperature the purge chamber and the heating chamber being disposed successively in said direction of conveyance;

said plurality of pushers include a first pusher for introducing the workpiece into said purge chamber and conveying the workpiece from said purge chamber to said heating chamber, and a second pusher for conveying the workpiece from said heating chamber to said carburizing zone, the second pusher being disposed at a lower level of height than said first pusher; and said lift mechanism is disposed in said heating chamber so as to move the workpiece downwards.

4. The continuous carburizing furnace according to claim 2, wherein said plurality of regions include a purge chamber adapted for isolating interior thereof from exterior atmosphere, and a heating chamber for heating the workpiece up to a pre-heating temperature that is not higher than a carburizing temperature the purge chamber and the heating chamber being disposed successively in said direction of conveyance;

said plurality of pushers include a first pusher for introducing the workpiece into said purge chamber and conveying the workpiece from said purge chamber to said heating chamber, and a second pusher for conveying the workpiece from said heating chamber to said carburizing zone, the second pusher being disposed at a lower level of height than said first pusher; and said lift mechanism is disposed in said heating chamber so as to move the workpiece downwards.

5. The continuous carburizing furnace according to claim 3, wherein the purge chamber is configured for performing a degreasing process on the workpiece as a pre-processing.

6. The continuous carburizing furnace according to claim 4, wherein the purge chamber is configured for performing a degreasing process on the workpiece as a pre-processing.

* * * * *